US005762648A

United States Patent [19]

Yeazell

[11] Patent Number: 5,762,648

[45] Date of Patent: Jun. 9, 1998

[54] FABRIC TREATMENT IN VENTING BAG

[75] Inventor: Bruce Albert Yeazell, Cincinnati, Ohio

[73] Assignee: The Procter & Gamble Company, Cincinnati, Ohio

[21] Appl. No.: 785,441

[22] Filed: Jan. 17, 1997

[51] Int. Cl.[6] ..... D06L 1/00

[52] U.S. Cl. ..... 8/137; 8/142; 510/515; 510/519; 510/295; 510/293; 510/297

[58] Field of Search ..... 8/137, 142; 510/515, 510/519, 295, 293, 297; 383/117, 84, 86, 88, 89

[56] References Cited

U.S. PATENT DOCUMENTS

| | | | |
|---|---|---|---|
| 1,747,324 | 2/1930 | Savitt . | |
| 3,432,253 | 3/1969 | Dixon et al. | 8/142 |
| 3,591,510 | 7/1971 | Zenk . | |
| 3,593,544 | 7/1971 | Henderson . | |
| 3,633,538 | 1/1972 | Hoeflin . | |
| 3,647,354 | 3/1972 | Loeb | 8/158 |
| 3,737,387 | 6/1973 | Marple . | |
| 3,764,544 | 10/1973 | Haworth . | |
| 3,882,038 | 5/1975 | Clayton et al. . | |
| 3,907,496 | 9/1975 | Néel et al. | 8/142 |

(List continued on next page.)

FOREIGN PATENT DOCUMENTS

| | | |
|---|---|---|
| 1005204 | 2/1977 | Canada . |
| 0 213 500 | 3/1987 | European Pat. Off. . |
| 0 261 718 | 3/1988 | European Pat. Off. . |
| 0 429 172 A1 | 5/1991 | European Pat. Off. . |
| 1397475 | 6/1975 | United Kingdom . |
| 1598911 | 9/1981 | United Kingdom . |
| 2302553 | 1/1997 | United Kingdom . |
| 2302878 | 2/1997 | United Kingdom . |
| 2302879 | 2/1997 | United Kingdom . |
| WO 91/09104 | 6/1991 | WIPO . |
| WO 91/13145 | 9/1991 | WIPO . |
| WO 93/25654 | 12/1993 | WIPO . |
| WO 96/39556 | 12/1996 | WIPO . |
| WO 97/00990A2 | 1/1997 | WIPO . |
| WO 97/00993A1 | 1/1997 | WIPO . |

OTHER PUBLICATIONS

Hunt, D.G. and N.H. Morris, "PnB and DPnB Glycol Ethers", *HAPPI*, Apr. 1989, pp. 78–82.

*Primary Examiner*—Alan Diamond

*Attorney, Agent, or Firm*—Steven R. Chuey; Kim William Zerby; Jacobus C. Rasser

[57] ABSTRACT

The present invention encompasses, in a process which comprises the steps of laundering or otherwise moistening fabrics using an aqueous medium, thereby securing damp fabrics and, thereafter, subjecting said damp fabrics to a drying process in a mechanical apparatus, the improvement which comprises: conducting said drying process by placing said damp fabrics in a vapor venting containment bag and drying said fabrics, thereafter removing said fabrics from said bag, whereby fabric shrinkage and wrinkling are minimized. The process herein is especially useful when the fabrics are cotton.

11 Claims, 5 Drawing Sheets

U.S. PATENT DOCUMENTS

| | | | |
|---|---|---|---|
| 3,949,137 | 4/1976 | Akrongold | 428/311 |
| 3,956,556 | 5/1976 | McQueary | 428/131 |
| 4,007,300 | 2/1977 | McQueary | 427/242 |
| 4,013,575 | 3/1977 | Castrantas et al. . | |
| 4,097,397 | 6/1978 | Mizutani et al. . | |
| 4,102,824 | 7/1978 | Mizutani et al. . | |
| 4,115,061 | 9/1978 | Grünewälder | 8/137 |
| 4,126,563 | 11/1978 | Barker . | |
| 4,130,392 | 12/1978 | Diehl et al. | 8/101 |
| 4,139,475 | 2/1979 | Schwadtke et al. . | |
| 4,336,024 | 6/1982 | Denissenko et al. | 8/142 |
| 4,395,261 | 7/1983 | Lutz | 8/111 |
| 4,532,722 | 8/1985 | Sax | 34/60 |
| 4,594,362 | 6/1986 | Smith et al. | 521/52 |
| 4,606,842 | 8/1986 | Keyes et al. . | |
| 4,659,496 | 4/1987 | Klemm et al. . | |
| 4,692,277 | 9/1987 | Siklosi . | |
| 4,706,802 | 11/1987 | Leigh et al. | 510/519 |
| 4,714,353 | 12/1987 | Leaphart | 383/117 |
| 4,758,641 | 7/1988 | Hsu | 526/208 |
| 4,797,310 | 1/1989 | Barby et al. | 428/71 |
| 4,802,997 | 2/1989 | Fox et al. . | |
| 4,806,254 | 2/1989 | Chruch . | |
| 4,849,257 | 7/1989 | Borcher et al. | 427/242 |
| 4,886,615 | 12/1989 | Dehan . | |
| 4,909,962 | 3/1990 | Clark . | |
| 4,943,392 | 7/1990 | Hastedt et al. . | |
| 4,966,724 | 10/1990 | Culshaw et al. . | |
| 4,983,317 | 1/1991 | Requejo et al. . | |
| 5,004,557 | 4/1991 | Nagarajan et al. . | |
| 5,041,230 | 8/1991 | Borcher et al. . | |
| 5,062,973 | 11/1991 | Kellett . | |
| 5,080,822 | 1/1992 | VanEenam . | |
| 5,102,573 | 4/1992 | Han et al. . | |
| 5,112,358 | 5/1992 | Deal | 8/137 |
| 5,173,200 | 12/1992 | Kellett . | |
| 5,213,624 | 5/1993 | Williams | 134/40 |
| 5,238,587 | 8/1993 | Smith et al. . | |
| 5,253,775 | 10/1993 | Gould | 220/403 |
| 5,547,476 | 8/1996 | Siklosi et al. | 8/142 |
| 5,591,236 | 1/1997 | Roetker | 8/137 |

FABRIC TREATMENT IN VENTING BAG

FIELD OF THE INVENTION

The present invention relates to a method for treating fabrics to protect the fabrics from shrinkage, to remove wrinkles, and to provide sanitization or other benefits thereto.

BACKGROUND OF THE INVENTION

Today, many consumers do not use automatic clothes dryers to dry cotton fabrics due to the risk of shrinkage. This is particularly true with certain types of dryers which, under certain circumstances, may tend to operate at higher temperatures than expected.

The present invention employs a containment bag which protects the fabrics from the heat of the dryer, thereby minimizing or avoiding the shrinkage problem. Moreover, the vapor flow-through characteristics of the bag allow materials such as perfumes, sanitizers, de-wrinkling agents, and the like, to be evenly deposited on and in the fabrics during the drying operation.

BACKGROUND ART

A peracid-containing dry cleaning composition is described in U.S. Pat. No. 4,013,575, issued to H. Castrantas, et al., Mar. 22, 1977. Dry cleaning processes are disclosed in: U.S. Pat. No. 5,547,476, issued Aug. 20, 1996, to Siklosi and Roetker; EP 429,172A1, published May 5, 1991 Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,594,362; 4,606,842; 4,758,641; 4,797,310; 4,802,997; 4,943,392; 4,966,724; 4,983,317; 5,004,557; 5,062,973; 5,080,822; 5,173,200; EP 0 213 500; EPO 261 718; G.B. 1,397,475; WO 91/09104; WO 91/13145; WO 93/25654 and Hunt, D. G. and N. H. Morris, "PnB and DPnB Glycol Ethers", HAPPI, April 1989, pp. 78–82.

SUMMARY OF THE INVENTION

The present invention encompasses, in a process which comprises the steps of laundering or otherwise moistening fabrics using an aqueous medium, thereby securing damp fabrics and, thereafter, subjecting said damp fabrics to a drying process in a mechanical apparatus, the improvement which comprises: conducting said drying process by placing said damp fabrics in a vapor venting containment bag and drying said fabrics, thereafter removing said fabrics from said bag, whereby fabric shrinkage and wrinkling are minimized. The process herein is especially useful when the fabrics are cotton, although other fabrics can be used.

In one mode, the fabrics are dried to a moisture level of from about 1% to about 10%, preferably about 1.5% to about 4%, within the bag. Thereafter, the fabrics are removed from the bag and drying is completed outside the mechanical apparatus, e.g., by air drying on a hanger. This not only minimizes shrinkage, but also minimizes wrinkling of the fabrics.

In an optional mode, the fabrics are impregnated with a treatment agent during the drying process in the mechanical apparatus. Such treatment agents include members selected from the group consisting of sanitizing agents, anti-wrinkling agents and perfumes, although other such agents can be used, as described hereinafter.

All percentages, ratios and proportions herein are by weight, unless otherwise specified. All documents cited are, in relevant part, incorporated herein by reference.

DETAILED DESCRIPTION OF THE INVENTION

Figure 1:
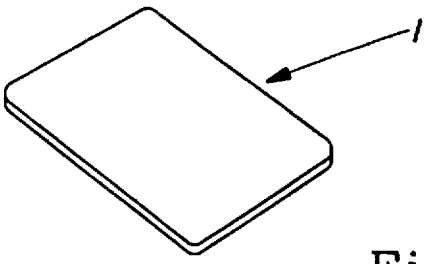
FIG. 1 is a stylized representation of a damp garment (1) for placement in the containment bag which is used in the present process.

Overall Process — The process of the present invention can be conducted in any convenient apparatus which is used to dry fabrics. In a convenient mode, the process is conducted with heating and, optionally, with tumbling, in an apparatus such as a conventional hot air clothes dryer.

The fabrics (e.g., garments such as blouses, shirts, trousers, sweaters, scarves and the like, as well as items such as curtains, draperies, etc.) are used herein in a moistened state. In one mode, the user can sprinkle or otherwise dispense water onto the fabrics. In another mode, the fabrics are laundered in a conventional laundering process, spun to remove excessive moisture and used in the process herein. Typically, and not by way of limitation, the "moistened" fabrics used herein will comprise from about 0.01X to about 3X, preferably about 0.1X to about 1X by weight of water per weight of fabric (i.e., a moisture "loading" of about 0.01X to about 3X, preferably about 0.1X to about 1X). This can vary with the type of fabrics and can be determined routinely without undue experimentation by the user. Said another way, the fabrics used herein can be "moist" or "damp", but are preferably not dripping wet since excessive wetness will require unduly long drying times.

As noted above, the fabrics being subjected to the present process can optionally be treated with various agents which are then evenly distributed across and/or infused into and throughout the fabrics and fibers during the process herein. By way of example and not limitation, various perfumes can be distributed and infused into the fabrics in this manner. Likewise, various phenolic, peroxide or other sanitizing agents can be evenly distributed and infused into the fabrics. Lubricious anti-wrinkling and de-wrinkling (i.e., fiber "relaxing") agents such as glycerol and glycols can be distributed and infused into the fabric. Sunscreens can be distributed and infused into the fabric to help reduce color fading. Fabric softeners and anti-static agents can be distributed and infused into the fabrics. All that is required is that the treatment agent be sufficiently mobilized in the moist atmosphere which develops within the containment bag during the present process so that even distribution and/or infusion can occur.

As can be seen from the foregoing, the moist fabrics to be treated in the present manner can be secured in several ways. The user can moisten an otherwise dry fabric. Or, the user can launder and rinse a fabric in the conventional way and use the resulting moist fabric in the process. Treatment agents, as noted above, can be applied via the moistening process, during the laundry/rinse process, or at another convenient time prior to conducting the process herein.

Containment Bag — The moist garments or other fabrics are loaded into the containment bag. Different from some processes disclosed in the art, the bag is not tightly sealed; rather, it is vented. Proper venting of the bag in the manner disclosed herein can minimize fabric wrinkling while facilitating the drying operation. Thus, the present invention employs a "vapor-venting" containment bag as shown in the Figures. The bag is preferably designed for multiple uses and reuses, and is especially adapted for use by the consumer in any conventional hot air clothes dryer apparatus, such as those found in the home or in commercial laundry/cleaning establishments but is not limited to use in such apparatus. The bag herein is specifically designed to vent water and other vapors which emanate from within the bag when used in the manner described herein. The vapors released from the bag are thence exhausted through the air vent of the dryer apparatus.

As described more fully hereinafter; the preferred bag is provided with a vapor-venting closure which provides one or more gaps through which vapors are released from the bag, in-use. In a preferred embodiment, the size of this gap is selected to provide controlled vapor release from the bag under the indicated operating conditions. While other gap sizes and operating conditions can be used, a preferred balance between vapor containment within the bag and vapor release from the bag has been determined using the principles disclosed hereinafter. Alternatively, the bag can be provided with a series of holes or other fenestrations which provide vapor venting. However, such venting is not as effective as the vapor-venting closure disclosed herein.

In one embodiment, the vapor-venting containment bag comprises an open end, a closed end and flexible side walls having inner and outer surfaces, the open end of said bag having a section of one side wall extending beyond said open end to provide a flexible flap, said flap having first fastening device affixed thereto, said flap being foldable to extend over a portion of the outside surface of the opposing side wall, said flap being affixable to the outer surface of the opposing wall of the bag by engaging said first fastening device on the inside face of the flap with a second fastening device present on the outside face of said opposing side wall, said first and second fastening devices, when thus engaged, forming a fastener, thereby providing a closure for the open end of the bag. Said first and second fastening devices are disposed so as, when engaged, to provide vapor-venting along said closure, especially at the lateral edges of the closure. The bag herein is most preferably formed from film which is heat resistant up to at least about 204° C.–260° C. Nylon is a preferred film material for forming the bag. In another embodiment, the edge of one wall of the bag is notched along a substantial portion of its width to facilitate and optimize vapor venting.

In an alternate mode, the flap can be folded to provide the closure, tucked inside the opposing side wall, and secured there by a fastener. In this mode, vapors are vented along the closure and especially at the lateral edges of the closure. In yet another mode, the side walls are of the same size and no flap is provided. Fastening devices placed intermittently along portions of the inner surfaces of the side walls are engaged when the lips of the side walls are pressed together to provide closure. One or more vapor-venting gaps are formed in those regions of the closure where no fastening device is present.

Figure 6:
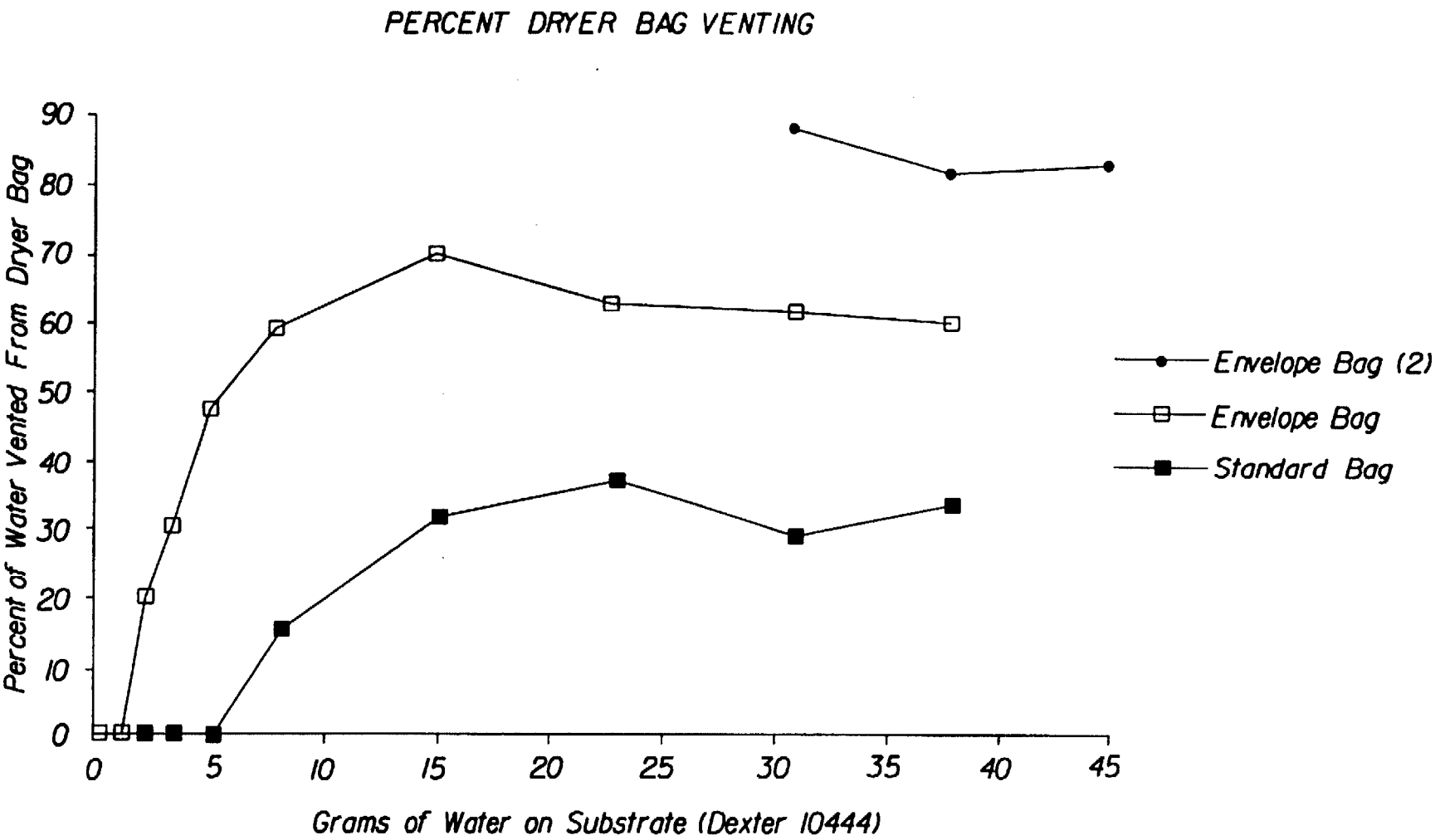
FIG. 6 is a graph of water venting from a vapor-venting "Envelope"-style Bag with the vapor-venting closure, from a Standard Bag, i.e., a sealed bag without the venting closure (as control for comparison purposes); and from an "Envelope Bag (2)" which has a vapor venting closure at each end.
Figure 7:
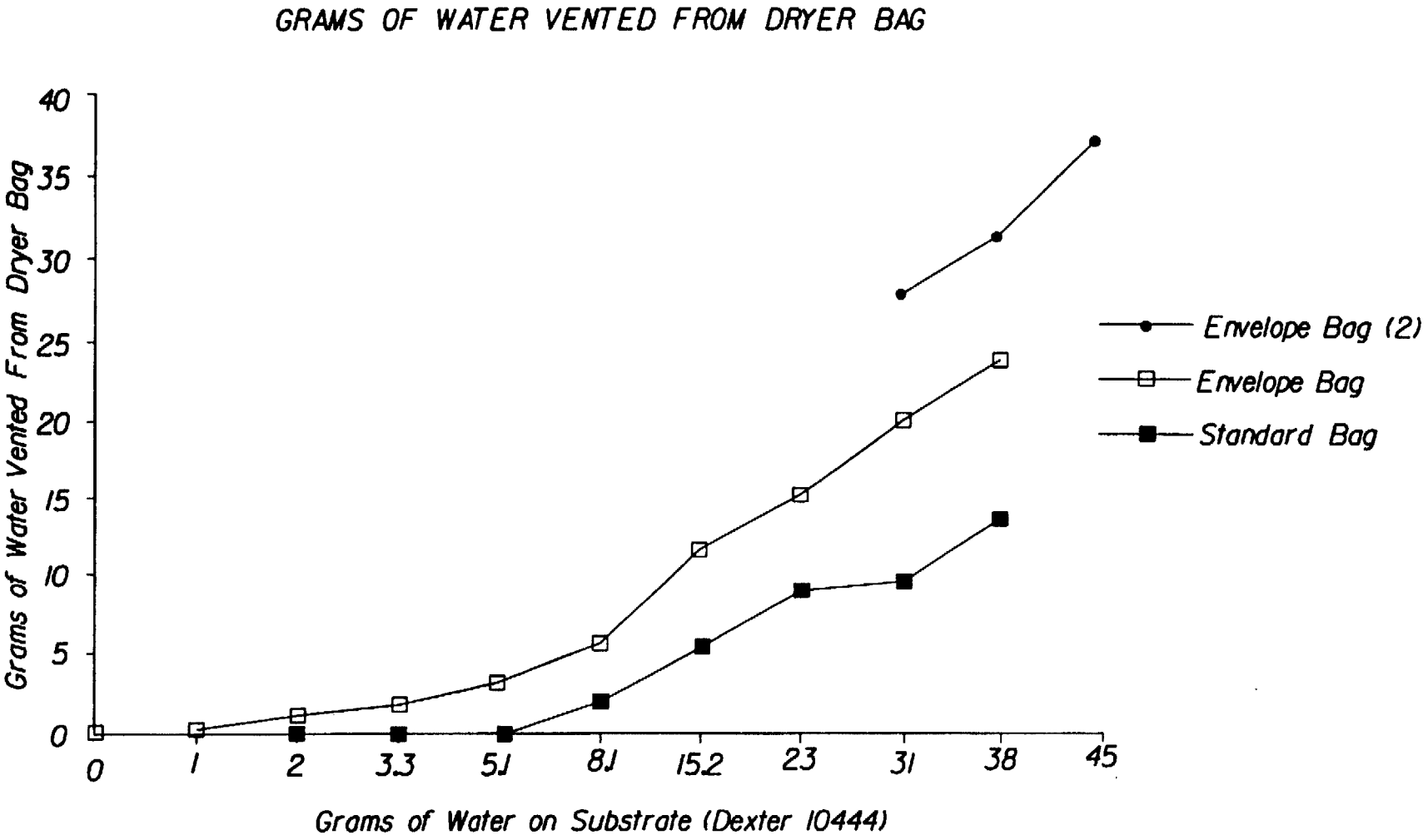
FIG. 7 is a graph of water venting as in FIG. 6, expressed in grams.

While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Nonlimiting examples include: bags wherein said first and second fastening devices, together, comprise a hook and loop (VELCRO®-type) fastener; hook fasteners such as described in U.S. Pat. 5,058,247 to Thomas & Blaney issued Oct. 22, 1991; bags wherein said first and second fastening devices, together, comprise a hook and string type fastener; bags wherein said first and second fastener devices, together, comprise an adhesive fastener; bags wherein said first and second fastening devices, together, comprise a toggle-type fastener; bags wherein said first and second fastening devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure. In yet another embodiment, both ends of the bag are provided with a vapor venting closure. This type of bag is referred to in FIGS. 6 and 7 as "Envelope Bag (2)". Preferred for use herein is the "Envelope Bag" whose venting is depicted in the middle curves shown in FIGS. 6 and 7.

Preferred bags of the foregoing type which are designed for use in a conventional U.S.-style automatic, in-home hot air clothes dryer will have a volume in the range from about 10,000 $cm^3$ to about 25,000 $cm^3$.

The bag is designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag. In another mode, a notch is cut along the edge of the side wall opposite the flap to further adjust the venting. The fastener devices shown in the Figures run only partly along the closure, thereby allowing venting to 15 also occur at the lateral edges of the closure. As an overall proposition, conducting the process in the manner disclosed herein results in minimal fabric shrinkage, especially with cotton fabrics, minimal formation of new wrinkles and removal of wrinkles which are already present in the garments prior to treatment. The fabrics, when removed from the bag, will usually contain a certain amount of moisture. This is not to say that the fabrics are, necessarily, frankly "damp" to the touch. Rather, the fabrics may feel cool, or cool-damp due to evaporative water losses. The fabrics thus secured may be hung to further air dry, thereby preventing wrinkles from being re-established. The fabrics can be ironed or subjected to other finishing processes, according to the desires of the user.

The following is intended to assist the formulator in the manufacture and use of vapor-venting bags in the manner of this invention, but is not intended to be limiting thereof.

Figure 3:
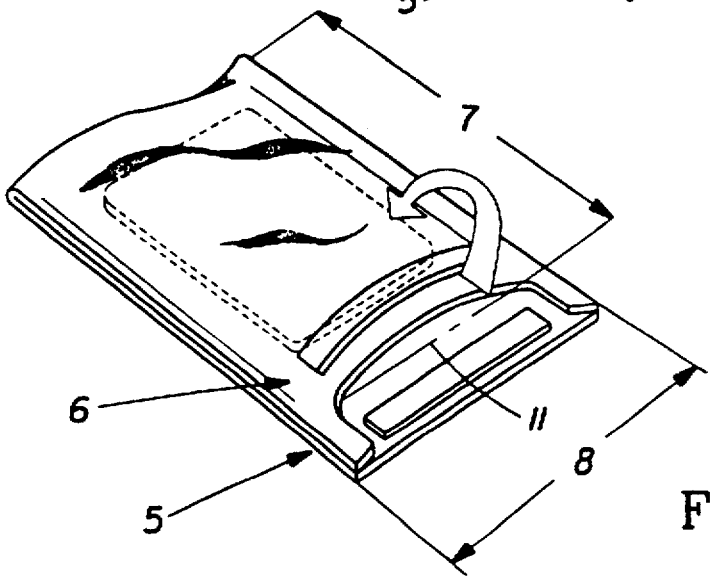
FIG. 3 is a perspective of the stylized garment within the bag which is ready to be treated in a hot air clothes dryer.

Bag Dimensions — FIG. 3 shows the overall dimensions of a notched bag: i.e., length (7) to fold line 27⅝ inches (70.2 cm); width (8) of bag 26 inches (66 cm), with a flap to the base of the fold line (11) of 2 ⅜ inches (6 cm). In the Tests reported hereinafter, this bag is referred to by its open dimensions as "26 in.×30 in." (66.04 cm×76.20 cm).

Figure 4:
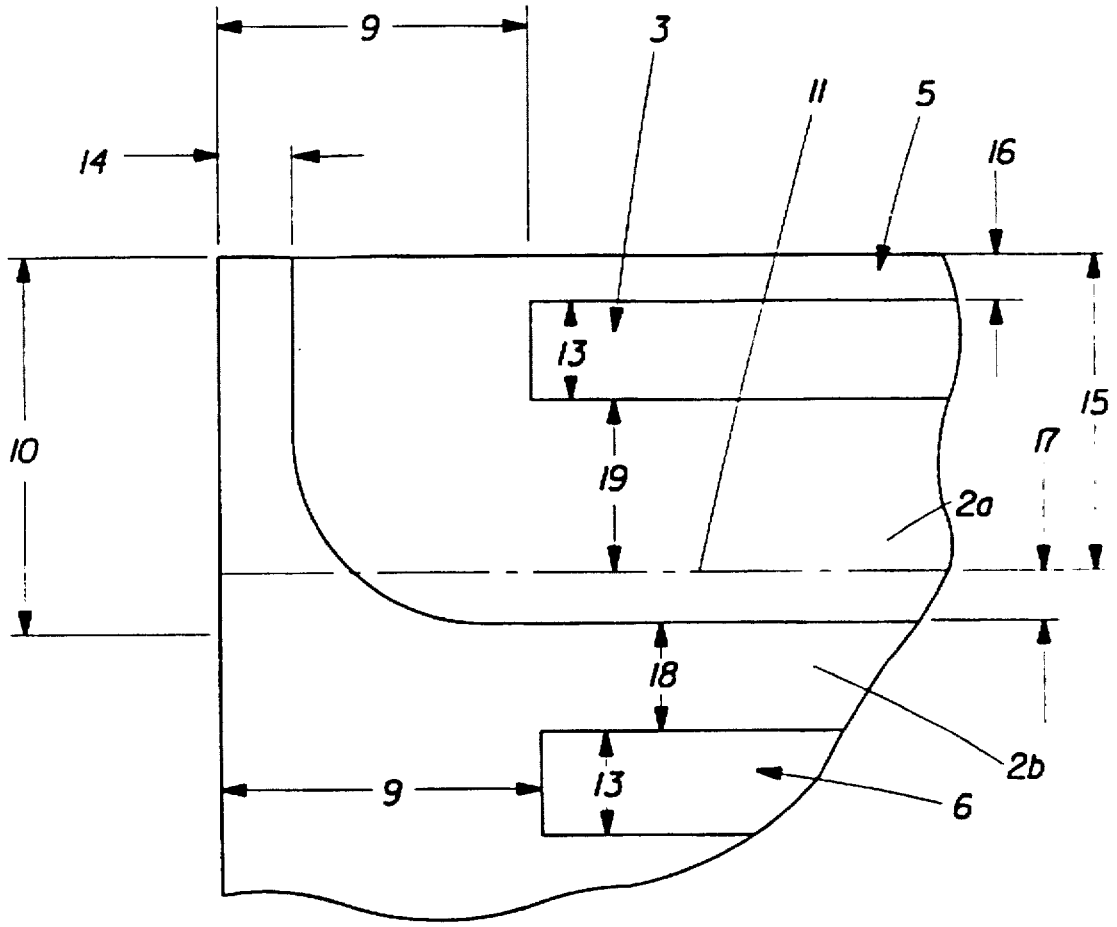
FIG. 4 is a partial view of the notched wall of the bag and its disposition relative to the closure flap.

FIG. 4 gives additional details of the positioning of the various elements of the notched bag. In this embodiment, all dimensions are the same for both the left hand and right hand sides of the bag. The dimensions herein are for an opened bag which is about 30 inches (76.2 cm) in overall length (including the flap) and about 26 inches (66 cm) wide. The distance (9) from the lateral edge of the bag to the outermost edge of the fastening device (3) located on the inside of the flap (5) is about 2 inches (5 cm). In this embodiment, the fastening device (3) on the inside of wall (2*a*) comprises the loop portion of a VELCRO®-type strip whose width (13) is about 0.75 inches (1.9 cm) and whose total length is about 22 inches (55.9 cm). Fastening device (6) is similarly situated on the outside of wall 2(*b*) and comprises the hook portion of a ¾ inch (1.9 cm) VELCRO®-type strip. Distance (9) can be decreased or increased to decrease or increase venting at the edges of the flap when the bag is closed and the fastener is engaged. The distance (10) between the uppermost edge of the flap and the base of the notch is about 2⅞ inches (7.3 cm). The distance (14) between the lateral edge of the bag and the lateral edge of the notch is about 0.25 inches (0.64 cm). The distance (15) between the uppermost edge of the flap and the fold (11) is about 2⅜ inches (6 cm). The distance (16) between the uppermost edge of the flap and the leading edge of the VELCRO®-type strip (3) affixed to the flap is about ⅜ inches (0.95 cm). The distance (17) between fold (11) and the lowermost edge of the notch is about ½ inch (1.27 cm). This distance also can be varied to decrease or increase vapor venting. A range of 0.25–1.5 inches (0.64–3.81 cm) is typical. The distance (18) between the uppermost edge of the VELCRO®-type strip (6) and the bottom edge of the notch is about ¾ inches (1.9 cm). The distance (19) between the bottommost edge of the VELCRO®-type strip (3) and the fold (11) is about 1¼ inches (3.17 cm).

Figure 5:
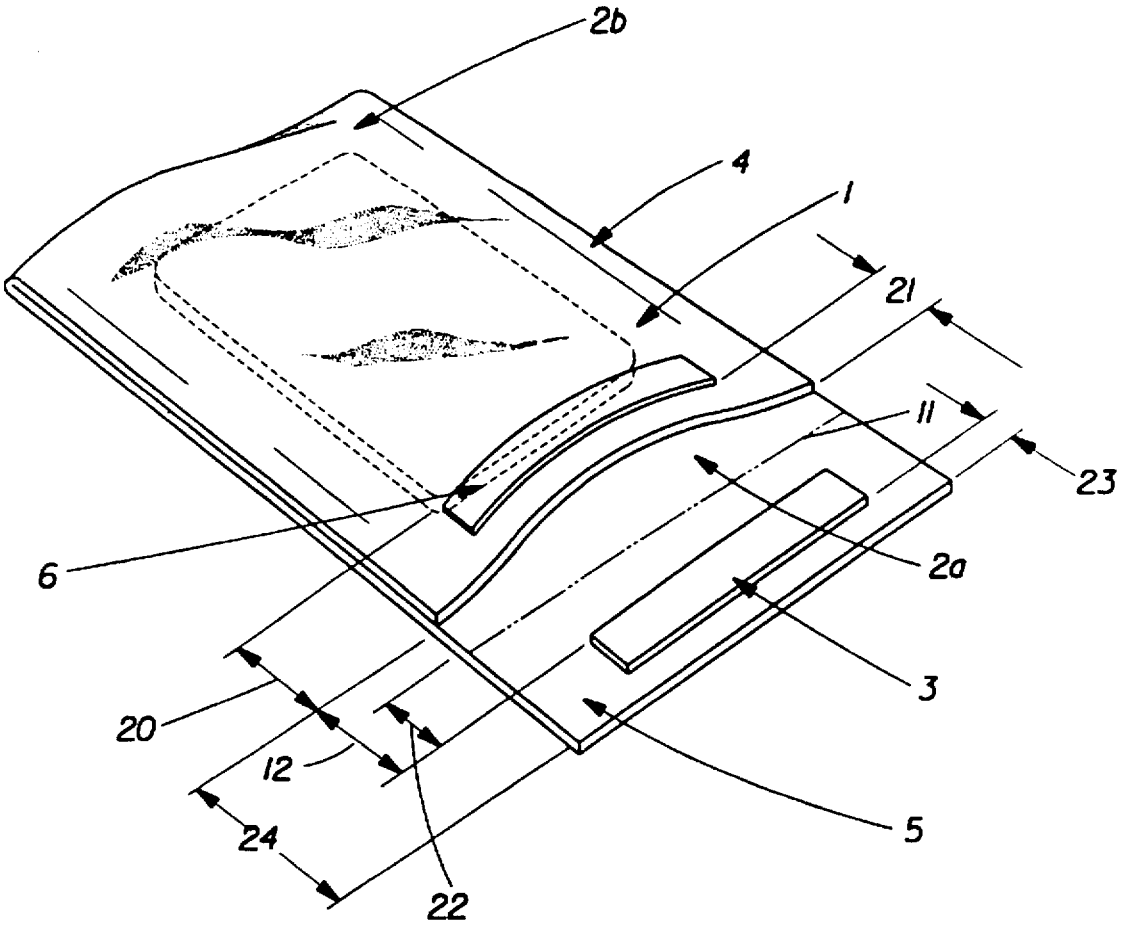
FIG. 5 is a perspective of an un-notched vapor-venting bag containing a loose damp garment (1; stylized representation) which is ready for drying by the present process.

FIG. 5 gives additional details of the dimensions of an un-notched envelope bag of the foregoing overall size comprising sidewalls (2*a*) and (2*b*). Again, each VELCRO®-type strip (3) and (6) is about ¾ inches (1.9 cm) in width and about 22 inches (55.9 cm) in length. Each strip is positioned so as to be inboard from each of the lateral edges of the finished bag wall and flap by about 2 inches (5 cm). The distance (12) between the leading edge of the sidewall (2*b*) to the base edge of the fastener strip (3) on the flap portion of the bag is about 2½ inches (6.35 cm). The distance (20) between the base edge of the fastener strip (6) to the leading edge of the sidewall (2*b*) is about 2.25 inches (5.7 cm). The distance (21) between the leading edge of the fastener strip (6) to the leading edge of the sidewall is about 1⅜ inches (3.5 cm). The distance (22) between fold (11) and the base edge of the fastener strip (3) is about 2 inches (5 cm). The distance (23) between the leading edge of fastener strip (3) and the uppermost edge of the flap which is an extension of sidewall (2*a*) is about 0.25 inches (0.64 cm). Distance (24) is about 3⅝ inches (9.2 cm). As in the foregoing notched bag, the positioning and length of the fasteners can be adjusted to decrease or increase venting.

The construction of the preferred, heat-resistant vapor-venting bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. As shown in FIGS. 3 and 5, in one embodiment, 1 to 3 mil (0.025–0.076 mm) heat-resistant Nylon-6 film is folded and sealed into a containment bag. Sealing can be done using standard impulse heating equipment. In an alternate mode, a sheet of nylon is simply folded in half and sealed along two of its edges. In yet another mode, bags can be made by air blowing operations. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two blouses. Alternatively, a larger bag suitable for handling a man's athletic garment can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bag herein is preferably flexible, yet is preferably durable enough to withstand multiple uses. The bag also preferably has sufficient stiffness that it can billow, in-use, thereby allowing its contents to tumble freely within the bag during use. Typically, such bags are prepared from 0.025 mm to 0.076 mm (1–3 mil) thickness polymer sheets. If more rigidity in the bag is desired, somewhat thicker sheets can be used. In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C). Under circumstances where excessive heating is not of concern, the bag can be made of polyester, polypropylene or any convenient polymer material.

Vapor Venting Evaluation — In its broadest sense, the preferred vapor-venting containment bag used in this invention is designed to be able to vent at least about 40%, preferably at least about 60%, up to about 90%, preferably no more than about 80%, by weight, of the total moisture introduced into the bag within the operating cycle of the clothes dryer or other hot air apparatus used in the process herein.

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed or subjected to other finishing operations.

Apart from the time period employed, the Vapor-Venting Equilibrium ("VVE") for any given type of vapor-venting closure will depend mainly on the temperature achieved within the dryer — which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

The following Vapor-Venting Evaluation Test (VVET) illustrates the foregoing points in more detail. Larger or smaller containment bags can be used, depending on the volume of the dryer drum, the size of the fabric load, and the like. As noted above, however, in each instance the containment bag is designed to chieve a degree of venting, or VVE "score", of at least about 40% (40 VVE), preferably at least about 60% (60 VVE), up to about 90% (90 VVE).

VAPOR-VENTING EVALUATION TEST

Materials:

Envelope or "Standard", i.e., Control Containiment Bag to be evaluated for VVE.

Carrier Substrate (15"×11"; 38.1 cm×27.9 cm) HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17"(114.3 cm×43.2 cm), Weight approx. 60 grams Pouch: 5"×6.375"(12.7 cm×16.2 cm) to contain the Carrier Substrate and water De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Fabric wrinkles can be visually assessed by skilled graders. For example, silk fabric, which wrinkles rather easily, can be used to visually assess the degree of wrinkle-removal achieved by the present processes using the vapor-venting bag. Other single or multiple fabrics can optionally be used. A laboratory test is as follows.

DE-WRINKLING TEST

MATERIALS:

As above for VVET.

De-ionized Water, Weight range (0–38 grams)

Pretreatment of Fabrics:

The silk fabric is placed in a hamper, basket, or drum to simulate normal conditions that are observed after wearing. These storage conditions produce garments that are severely wrinkled (well defined creases) and require a moist environment to relax the wrinkles.

TEST PROCEDURE:

1. One silk fabric is placed in a containment bag being tested.
2. Water (0–38 grams) is applied to the carrier substrate a minimum of 30 minutes before running the test, placed in a pouch and sealed.
3. The silk garment is placed in the test containment bag along with the watercontaining substrate (removed from its pouch and unfolded).
4. The bag is closed and placed in a Whirlpool Dryer (Model LEC7646DQO) for 30 minutes at high heat (48–74C cycle).
5. At the end of 30 minutes, the dryer bag is removed from the dryer IMMEDIATELY and the silk garment is placed on a hanger.
6. The silk garment is then visually graded versus the Control Garment from the same Pretreatment Of Fabrics.

Perfume — As noted above, various treatment agents can be applied to the fabrics during the present process. One type of agent comprises various perfume materials. However, the perfumer should select at least some perfume chemicals which are sufficiently high boiling that they are not entirely vented from the bag along with the water vapors during the drying process herein. A wide variety of aldehydes, ketones, esters, acetals, and the like, perfumery chemicals which have boiling points above about 50° C., preferably above about 85° C., are known. Such ingredients can be delivered by the process herein and caused to permeate the garments of the containment bag during the processes herein. Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

PROCESS CONDITIONS

Figure 2:
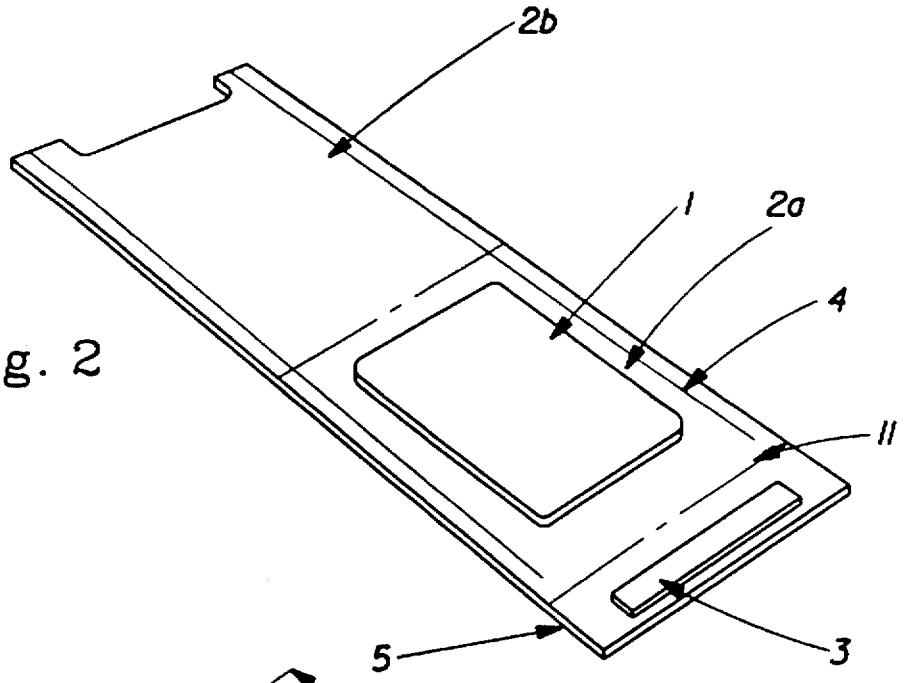
FIG. 2 is a perspective of the damp garment loosely resting on a notched, vapor-venting containment bag which is in a pre-folded condition.

As illustrated in the drawings, FIG. 1 shows a stylized representation of a moist garment (1) for use herein. FIG. 2 illustrates one form of a pre-formed, notched containment bag in an open configuration with the loose garment (1), first side wall (2*a*), second side wall (2*b*), first fastening device (3), side seal (4) and flexible flap (5). In use, flexible flap (5) is folded along fold line (11) to provide the vapor-venting closure for the bag.

FIG. 3 shows the "envelope-style" notched bag in a finished configuration and loosely containing the moist garment (1). In-use, flap (5) is folded along fold line (11) to engage first fastening device (3) with the opposing second fastening device (6) to fasten the flap, thereby providing a vapor-venting closure which is sufficiently stable to withstand tumbling in a hot air clothes dryer or similar device.

FIG. 4 shows a cut-away view of the corner of the notched containment bag illustrating the interior of the first side wall (2*a*) and second side wall (2*b*), first fastening device (3), second fastening device (6), flap (5), and fold line (11). The distance between the edge of the bag (9) and the depth of the notch (11) in second side wall (2*b*) are dimensions which are set forth hereinabove.

FIG. 5 depicts the un-notched venting bag with the moist garment loosely contained therein.

The dimensions given hereinabove are for containment bags which are designed to tumble freely within the drum of a conventional, U.S.-style in-home hot air clothes dryer having a drum volume of about 170–210 liters (home size). The bag of the stated dimensions is designed to treat up to about 5 kg fabric load in a single use. The dimensions can be adjusted proportionately for larger or smaller bags to achieve the desired VVE and to ensure effective use in dryers with larger or smaller drums. For example, the total volume of a containment bag constructed for use in an average European home clothes dryer (or U.S. "apartment" size; ca. 90 liter drum volume) would be about 60% of the volume for an average U.S. dryer.

In a typical mode, the nylon or other heat-resistant vapor-venting bag with the moist fabric being dried is closed and placed in the drum of an automatic hot air clothes dryer at temperatures of 40° C.–150° C. The drum is allowed to revolve, which imparts a tumbling action to the bag and agitation of its contents concurrently with the tumbling. The tumbling and heating are carried out for a period of at least about 10 minutes, typically from about 20 minutes to about 60 minutes. This step can be conducted for longer or shorter periods, depending on such factors as the nature of fabrics, the fabric load, the amount of heat applied, and the like, according to the needs of the user. During the step, greater than about 40%, preferably greater than about 80%, of the moisture is preferably vented from the bag. With respect to the wrinkle-removing function of the process herein, it will be appreciated that wrinkling can be affected by the type of fabric, the fabric weave, fabric finishes, and the like. For fabrics which tend to wrinkle, it is preferred not to overload the vapor-venting bag used herein. Thus, for a bag with, for example, an operational capacity of up to about 5 kg of fabrics, it may be best to process up to only about 60% of capacity, (i.e., up to about 3 kg) of fabrics to further minimize wrinkling.

The following Examples further illustrate the present invention, but are not intended to be limiting thereof.

EXAMPLE I

A load of cotton garments is laundered in a conventional top loading automatic washing machine, including the rinse and "spin-dry" cycle. Three pounds (based on dry weight of garments) of the resulting damp garments are placed loosely in a ca. 25,000 $cm^3$ vapor-venting containment bag of the type depicted in FIG. 5. The air is preferably not squeezed out of the bag. The flap of the bag is closed to provide a venting gap at the bag's mouth. The bag and its contents are placed in a conventional hot air clothes dryer, which is operated in standard fashion for 20–40 minutes with heating at 40° C.–150° C., on average, and with tumbling. When the garments are nearly dry (ca. 2–3% moisture level) they are removed from the bag and allowed to air-dry.

EXAMPLE II

Damp cotton garments are sprayed with a 1% (wt.) aqueous perfume composition. The garments are placed in a vapor-venting bag and treated in the manner of Example I. The perfume permeates the garments to provide a long-lasting freshness impression.

EXAMPLE III

Cotton garments are evenly dampened by spraying them with a 1% (wt.) aqueous 1:1 mixture of phenolic hydrocarbons (phenol; sodium phenolate) and natural oils (eugenol; citrus oil terpenes). Typically, the aqueous mixture is used at a level which is approximately 25%, by weight, of the garments being treated (i.e. 0.25X). The dampened garments are then treated in the manner of Example I. The garments are thus permeated with the phenolics/oils to provide a sanitizing benefit.

What is claimed is:

1. A process of laundering or otherwise treating moist fabrics comprising the steps of:

placing the moist fabrics in a vapor venting containment bag;

heating the bag to a temperature sufficient to vaporize the moisture in the bag, whereby at least about 40% but less than about 90%, by weight of the total moisture introduced into the bag, is vented therefrom; and removing the fabrics from the bag.

2. The process according to claim 1, wherein at least about 40% but less than about 80% by weight of the total moisture introduced into the bag is vented therefrom.

3. The process according to claim 1, wherein at least about 60% but less than about 80% by weight of the total moisture introduced into the bag is vented therefrom.

4. A process of laundering or otherwise treating fabrics comprising the steps of:

placing the fabrics in a vapor venting containment bag;

adding moisture to the bag to increase the level of moisture within the bag and thereby increasing the level of moisture of the fabrics;

heating the bag to a temperature sufficient to vaporize the moisture in the bag, whereby at least about 40% but less than about 90%, by weight of the total moisture introduced into the bag, is vented therefrom; and removing the fabrics from the bag.

5. A process according to claim 4 wherein the fabrics are cotton.

6. A process according to claim 4 wherein the fabrics are dried to a moisture level of from about 1% to about 10% within the bag.

7. A process according to claim 6 wherein the heating is in a mechanical apparatus and after the fabrics are removed from the bag, drying is completed outside the mechanical apparatus.

8. A process according to claim 4 wherein the fabrics are impregnated with a treatment agent during the heating step.

9. A process according to claim 8 wherein the treatment agent is a member selected from the group consisting of sanitizing agents, anti-wrinkling agents and perfumes.

10. The process according to claim 4, wherein at least about 40% but less than about 80% by weight of the total moisture introduced into the bag is vented therefrom.

11. The process according to claim 4, wherein at least about 60% but less than about 80% by weight of the total moisture introduced into the bag is vented therefrom.

* * * * *